United States Patent [19]

Fix et al.

[11] 4,142,382

[45] Mar. 6, 1979

[54] ADJUSTABLE TOE RING

[76] Inventors: Linda M. Fix, 1805 Kent Rd., Pittsburgh, Pa. 15241; Gloria L. Lepiane, 365 Canan Dr., Pittsburgh, Pa. 15236

[21] Appl. No.: 783,193

[22] Filed: Mar. 31, 1977

[51] Int. Cl.[2] ..... A44C 9/02; A44C 25/00

[52] U.S. Cl. ..... 63/2; 63/15.65; 63/29 R

[58] Field of Search ..... 63/2, 15, 15.6, 15.65, 63/15.7, 29 R

[56] References Cited

U.S. PATENT DOCUMENTS

| | | | |
|---|---|---|---|
| D. 67,567 | 6/1925 | Alterton | 63/15 UX |
| D. 126,373 | 4/1941 | Braun | 63/15 UX |
| D. 151,789 | 11/1948 | Shapiro | 63/2 UX |
| 403,112 | 5/1889 | Kaffeman | 63/29 R |
| 581,922 | 5/1897 | Schrader | 63/15.7 |
| 899,296 | 9/1908 | Elliot | 63/29 R |
| 2,208,642 | 7/1940 | Neuwirth | 63/29 R UX |

FOREIGN PATENT DOCUMENTS

| | | | |
|---|---|---|---|
| 1019446 | 2/1966 | United Kingdom | 63/15 |

*Primary Examiner*—F. Barry Shay
*Attorney, Agent, or Firm*—Donald C. Lepiane

[57] ABSTRACT

An adjustable toe ring includes a flexible body engaging member having spaced end portions for receiving a cap. Securing the cap on the end portions urges the body engaging member about the toe.

10 Claims, 7 Drawing Figures

ADJUSTABLE TOE RING

BACKGROUND OF THE INVENTION

1. Field of the Invention

This invention relates to a ring and more particularly to a toe ring.

2. Discussion of the Prior Art

Adjustable rings are known in the prior art. In general, the prior art rings include an open ended circular shaped strip of formable metal. The strip slides over the finger and is thereafter pressed to urge the strip about the finger. Normally, a zodiac sign, a decorative design, e.g., initials or a colorful ceramic disc is mounted on the strip.

Although the above type of adjustable rings are acceptable, there are drawbacks. For example, having the ends of the circular shaped strip overlap detracts from the anesthetic appeal of the ring. Furthermore, the ring is not easily adaptable for use on a toe. This is because the fingers, normally, increase in thickness as the distance from the finger tip increases whereas the end of the toe is normally larger than the remainder of the toe. Therefore, the prior art type rings when used on the toe requires that the circular strip be spread apart to clear the end of the toe. This expanding and compressing of the circular strip may deform the strip and detract from the aesthetic appeal.

It would be advantageous therefore to provide a ring that may be worn on the toe or finger and does not have the drawback of the prior art finger rings.

SUMMARY OF THE INVENTION

This invention relates to a ring for an appendage, e.g., a toe. The ring includes a cap and an open ring-shaped body portion having a pair of spaced tabs. Facilities mount the cap and the tabs for securing the cap on the tabs while urging the tabs together to decrease the inside diameter of the body portion.

DETAILED DESCRIPTION OF THE INVENTION

In the following discussion, the ring of the invention will be discussed for use on a toe of a foot; however, the invention is not limited thereto and may be used on the fingers. Further, in the following discussion, like numerals refer to like elements.

Figure 1:
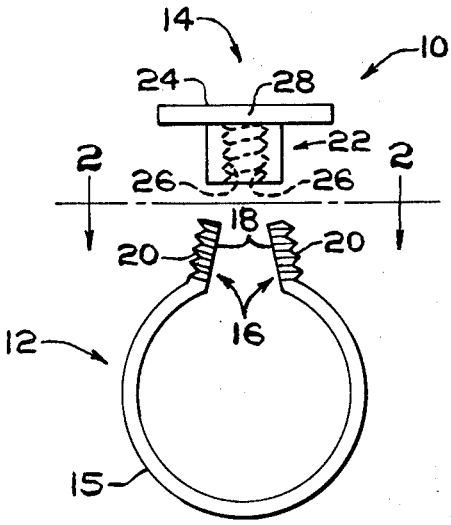
FIG. 1 is a side view of a ring incorporating features of the invention.

With reference to FIG. 1, there is shown a ring 10 incorporating features of the invention. The ring 10 includes a body engaging member 12 and a cap 14. The body engaging member 12 is made of a flexible material, e.g., metal or plastic having a circular portion or an open ring-shaped body portion 15 for mounting on the body of a toe (not shown). The open ring-shaped body portion 15 terminates in a pair of spaced tabs 16—16.

Figure 2:
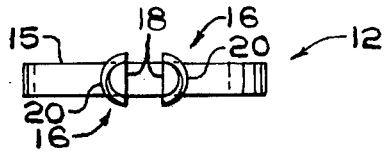
FIG. 2 is a view taken along lines 2—2 of FIG. 1.

The tabs 16 are identical in construction and have a flat surface 18 and an opposite threaded portion 20 as shown in FIGS. 1 and 2. Preferably the tabs 16 are angled toward each other so that the inside diameter of the open ring-shaped body portion 15 decreases as the distance between the flat surfaces 18 decreases in a manner to be discussed below.

The cap 14 includes a hollow body portion 22 preferably secured to a plate member 24. The hollow body portion 22 has internal threads 26 for receiving the tabs 16 of the body engaging member 12. As shown in FIG. 1, the inside diameter of the hollow body portion 22 is preferably constant throughout its depth. In this manner, as the cap 14 is threaded onto the tabs 16, the open ring-shaped body portion 15 is urged against the body of the toe.

Figure 3:
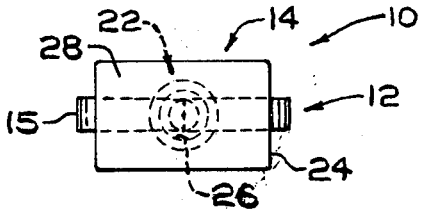
FIG. 3 is an elevated view of the ring shown in FIG. 1.

With reference to FIG. 3, the upper surface 28 of the plate member 24 may be decorated with zodiac designs, phrases, birth stones or any type of decoration desired and is not limiting to the invention.

One of the advantages of the ring shown in FIGS. 1–3 is that caps 14 each having a different design on the surface 28 may be used with one body engaging member 12. The change may be made depending on the desire of the wearer. Another advantage of the ring 10 is the ease with which it may be mounted on the toe or finger. For example, the open ring-shaped body portion 15 is placed on the finger or toe and then the cap 14 secured on as previously discussed.

Figure 4:
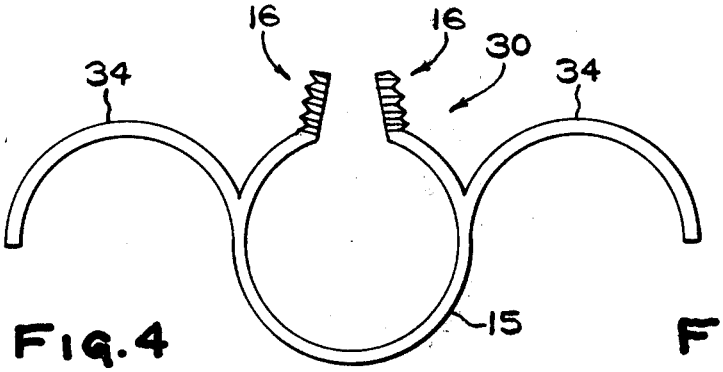
FIG. 4 is a side view of an alternate embodiment of a body engaging member incorporating features of the invention.
Figure 5:
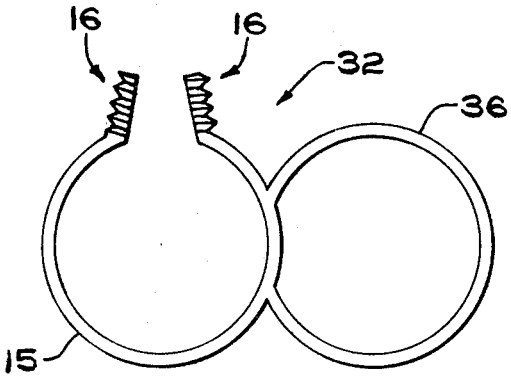
FIG. 5 is a side view of another embodiment of a body engaging member incorporating features of the invention.

Shown in FIGS. 4 and 5 are modified body engaging members 30 and 32, respectively, similar to the body engaging member 12 of ring 10 with the differences discussed below.

With specific reference to FIG. 4, the body engaging member 30 may be provided with arcuate shaped members 34 extending from the open ring-shaped body portion 15. The arcuate shaped members 34 engage adjacent toes and fingers (not shown) on each side of the mounted finger or toe.

In FIG. 5, a circular member 36 is mounted on the open ring-shaped body portion 15. The inside diameter of the circular member 36 is sized to pass over the toe or finger adjacent to the mounted toe or finger. The arcuate members 34 and circular member 36 prevent the ring from rotating on the mounted toe or finger and in this manner maintain the upper surface 28 of the plate member 24 shown in FIGS. 1 and 3 in view.

As can now be appreciated, other locking arrangements between the cap 14 and the spaced tabs 16 on the open ring-shaped body portion 15 may be made within the scope of the invention. For example, the internal threads 26 of the cap 14 may be tapered inwardly and the surface 18 of the tabs 16 substantially spaced equally apart along their length.

Figure 6:
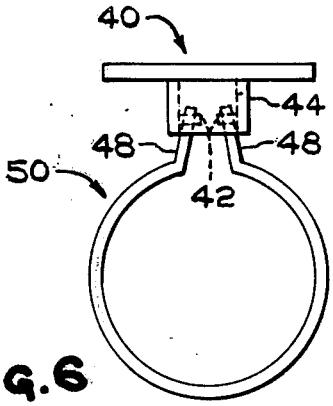
FIG. 6 is a side view of an alternate embodiment of a ring incorporating features of the invention.
Figure 7:
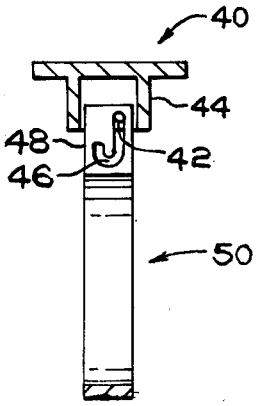
FIG. 7 is a side view of the ring shown in FIG. 6 having portions removed for purposes of clarity.

Further, as shown in FIGS. 6 and 7, cap 40 may be provided with a pair of spaced elongated members 42 mounted in circular body 44. Ones of the members 42 are mounted in ones of a J-shaped slot 46 formed on each tab 48 of the body engaging member 50. The cap 40 is moved downward as viewed in FIG. 6 over the tabs 48 to urge the body engaging member 50 against the finger or toe and then turned to lock the cap 40 in place.

As can now be appreciated, the invention is not limited to the above embodiments and variations may be made within the scope of the invention.

What is claimed is:

1. A ring for an appendage comprising:
an open ring-shaped portion having a pair of spaced tabs at the ends thereof;
a cap having a hollow body;
said tabs and internal walls of said hollow body being sloped relative to one another to adjust the size of said ring-shaped body when said hollow body is displaced relative to said tabs; and
means on said cap and said body portion for securing said cap on said tabs while urging said tabs together to decrease inside dimension of said ring-shaped body portion, said securing means being capable of securing said cap on said tabs in any of a plurality of positions.

2. The ring as set forth in claim 1 further including:
means mounting said ring-shaped body portion for minimizing rotation of said ring-shaped body portion when ring is mounted.

3. The ring as set forth in claim 2 wherein said minimizing means is mounted on outer surface of said ring-shaped body portion.

4. The ring as set forth in claim 2 wherein said minimizing means includes a pair of engaging members mounted on outer surface of said ring-shaped body portion in spaced relation to one another.

5. The ring as set forth in claim 1 wherein said securing means includes:
threads mounted on each of said tabs; and
said hollow body having internal threads.

6. The ring as set forth in claim 1 wherein said securing means includes:
said tabs having a groove; and
said hollow body having spaced elongated members receivable in the groove.

7. The ring as set forth in claim 1 wherein said securing means includes:
said tabs having opposed walls generally parallel to one another; and
said hollow body having inwardly sloping walls.

8. The ring as set forth in claim 1 wherein said cap includes a plate.

9. The ring as set forth in claim 1 wherein said securing means includes:
said tabs angled relative to one another; and
said hollow body having a generally constant internal diameter.

10. The ring as set forth in claim 9 wherein said securing means further includes:
threads mounted on each of said tabs; and
said hollow body portion having internal threads.

* * * * *